United States Patent [19]

Furutsu

[11] Patent Number: 4,482,087

[45] **Date of Patent: * Nov. 13, 1984**

[54] TAG ATTACHING DEVICE

[75] Inventor: Akira Furutsu, Tokyo, Japan

[73] Assignees: Japan Bano'k Co., Ltd., Tokyo, Japan; Ben Clements & Sons, Inc., South Hackensack, N.J.

[ * ] Notice: The portion of the term of this patent subsequent to Jul. 24, 2001 has been disclaimed.

[21] Appl. No.: 326,953

[22] Filed: Dec. 2, 1981

[30] Foreign Application Priority Data

Dec. 12, 1980 [JP] Japan ..... 55-175426

[51] Int. Cl.[3] ..... B25C 1/00

[52] U.S. Cl. ..... 227/67; 226/166

[58] Field of Search ..... 227/67; 226/127–128, 226/134, 165, 166, 67, 68, 120, 121; 198/750, 772, 859

[56] References Cited

U.S. PATENT DOCUMENTS 3,924,788 12/1975 Furutsu ..... 227/67

*Primary Examiner*—E. R. Kazenske
*Assistant Examiner*—Douglas D. Watts
*Attorney, Agent, or Firm*—Blum, Kaplan, Friedman, Silberman & Beran

[57] ABSTRACT

Disclosed is an improved tag attaching device, of which the feeding mechanism for feeding tag pins of a loaded tag pin assembly one at a time comprises a cam plate movable up and down along a guide groove in which the tag pin assembly is insertion loaded, an engaging pawl member pivotally mounted to the cam plate, and a spring mounted between the engaging pawl member and the main body, and in which when the cam plate is upwardly moved against the spring force of the spring, the engaging pawl member is rotated to have its front end sticked into the connecting bar of the tag pin assembly, and as the cam plate and the engaging pawl members are lowered by the function of the spring, the tag pin assembly is fed downwardly.

3 Claims, 8 Drawing Figures

TAG ATTACHING DEVICE

BACKGROUND OF THE INVENTION

The present invention relates to the field of tag attaching devices and, more particularly, to an improved device for dispensing tag pins made of a plastic and dispensed in attaching price tags, labels or the like to a variety of pieces of merchandise.

Plastic-made tag pins, which are today widely utilized in, for example, anchoring various tags or the like to various goods, are individually composed of a head, a crossbar and a filament interconnecting the head and the crossbar, altogether forming a substantially H-shaped integral body. Further, a plurality of such tag pins are integrally arranged at predetermined intervals or at a predetermined pitch in the thickness direction of the head for example to altogether form a comb-like assembly. That is to say, a multiplicity of individual tag pins are connected about their joint portions to a common connecting bar alike a multiplicity of teeth in a comb. In greater detail, each tag pin has a joint portion connected to and extending from its crossbar, and through such joint portion, it is connected to a connecting bar common to all individual tag pins in a tag pin assembly.

Today, tag pins of various sizes and configurations are commercially available, and a variety of tag pin assemblies are commercially utilized, which have variously different pitches in the arrangement of individual tag pins.

The tag attaching device to which the present invention more directly relates than a tag pin or tag pin assembly per se is a device having an overall structure resembling a pistol and is adapted to separate and dispense individual tag pins of a tag pin assembly one at a time relative to items of merchandise. In operation with the device, a tag pin severed out of the assembly is guided with its crossbar through a hollow needle of the device having an elongated slot and is driven to penetrate a tag or a preparatively provided hole of the latter and also an objective item of merchandise so as thereby to have the tag attached to the objective merchandise item.

In conventional tag attaching devices, a feeding device is provided, which includes a gear having gear teeth adapted to engage the joint portion of tag pins and in which by the action of the gear individual tag pins of a tag pin assembly charged in the device are intermittently successively fed to the hollow needle. The gear has only a constant pitch of gear teeth, therefore the tag attaching device cannot be effectively employed for dispensing such tag pin assemblies as having a pitch of the tag pin arrangement not corresponding to the pitch of the gear teeth of its feeding device. Thus, in order to carry out tag attaching operations with a variety of tag pin assemblies having different pitches of the tag pin arrangement, it is today indispensable to provide a corresponding variety of tag attaching devices having different pin-feeding gear teeth pitches.

SUMMARY OF THE INVENTION

In view of the above indicated difficulty with the existing tag attaching devices, the present invention is directed in its primary object to provide an improved tag attaching device which can be effectively utilized in connection with a variety of tag pin assemblies having different pitches of the tag pin arrangement.

To this end, according to the present invention there is provided such a tag attaching device or tag pin dispensing device which comprises a main body, an intermediate lever pivotally secured to the main body, a spring mounted between the main body and the intermediate lever and urging a lever supported on the main body through the intermediate lever to project forwardly of a grip portion of the main body, a supporting member loosely fitted in the intermediate lever and slidably received in the main body, a cam driving member loosely fitted to the intermediate lever and disposed parallel to the supporting member, a push-out rod fixed to the slidable supporting member, a hollow needle having a guide groove formed at a rear end part thereof, which is disposed ahead of the push-out rod and fixed to the main body, a cam plate disposed adjacent the guide groove so as to correspond in location to the cam driving member, an engaging pawl member pivotally mounted on the cam plate and disposed so as to correspond in location to the guide groove through which the connecting bar of the tag pin assembly is guided, and a spring mounted between the main body and the engaging pawl member and normally urging the cam plate toward below.

The above and other objects, features and advantages of the present invention will become apparent from considering the following description in conjunction with the accompanying drawings.

DESCRIPTION OF THE PREFERRED EMBODIMENTS

Figure 1:
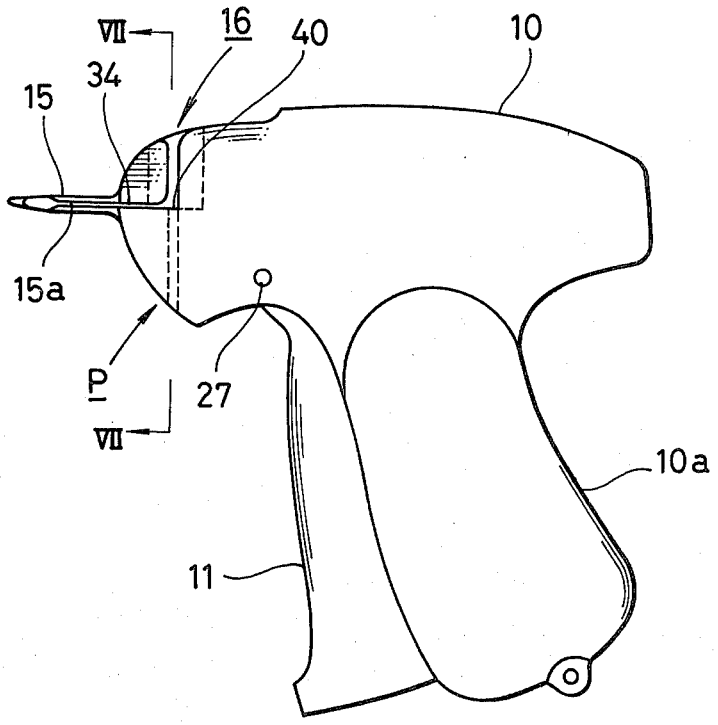
FIG. 1 shows a side elevational view of a tag attaching device in accordance with the present invention.
Figure 2:
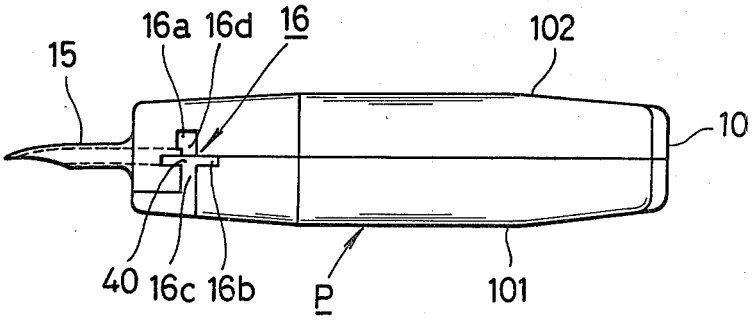
FIG. 2 is a top plan view of the device shown in FIG. 1.

A tag attaching device or a tag pin dispensing device according to the present invention, which is generally shown by the letter P in FIGS. 1 and 2, has an overall structure resembling a pistol and comprises a main body 10 made of a plastic material, which consists of two halves 101 and 102 as shown in FIG. 2 and to which a lever 11 is pivotally secured through a shaft 27.

Figure 3:
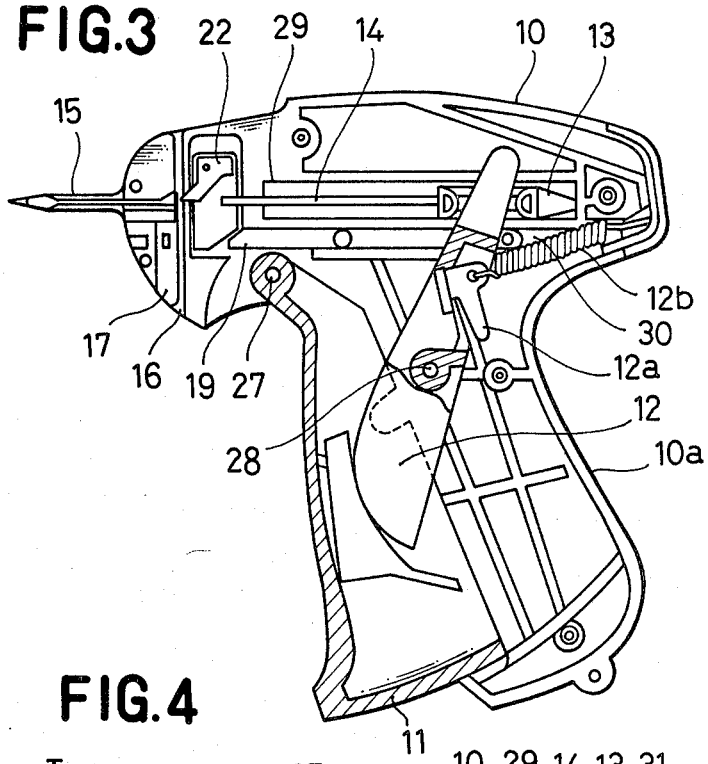
FIG. 3 is a side elevational view, showing one of two slit halves of the device of FIG. 1.

As shown in FIG. 3, an intermediate lever 12 is pivotally attached to a grip portion 10*a* of the device through a shaft 28. A spring 12*b* is mounted between a supporting member 12*a* formed on the intermediate lever 12 and a rear end portion of the main body 10, and it normally urges the lever or operation lever 11 to project forwardly away the grip portion 10*a* as shown in FIGS. 1 and 3.

In a groove 29 in the main body 10*a*, a slider 13 is slidably received, and to the front end of this slider 13, a push-out rod 14 is fixed. Also, in a groove 30 formed beneath the groove 29 so as to extend parallel with the latter, a cam driving member 19 is slidably mounted.

Figure 4:
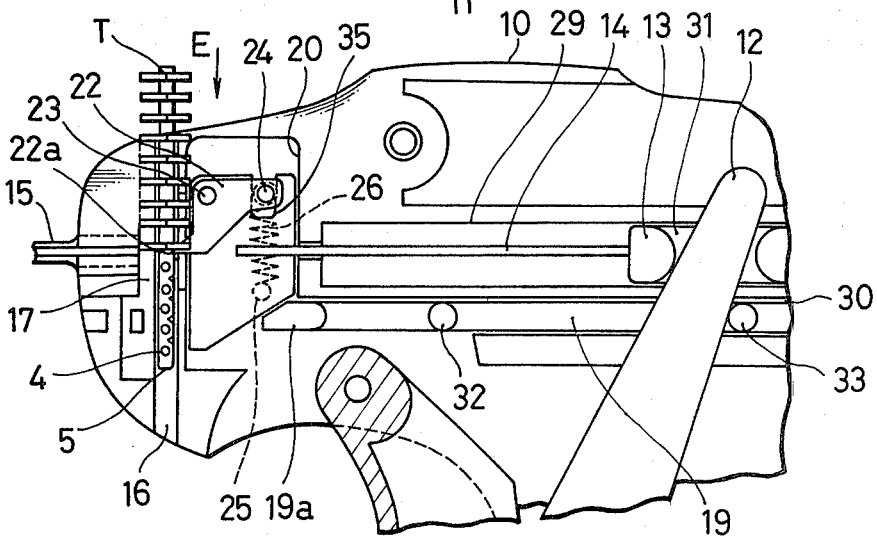
FIGS. 4 and 5 are respectively an enlarged view of a same portion of the device of FIG. 1.
Figure 5:
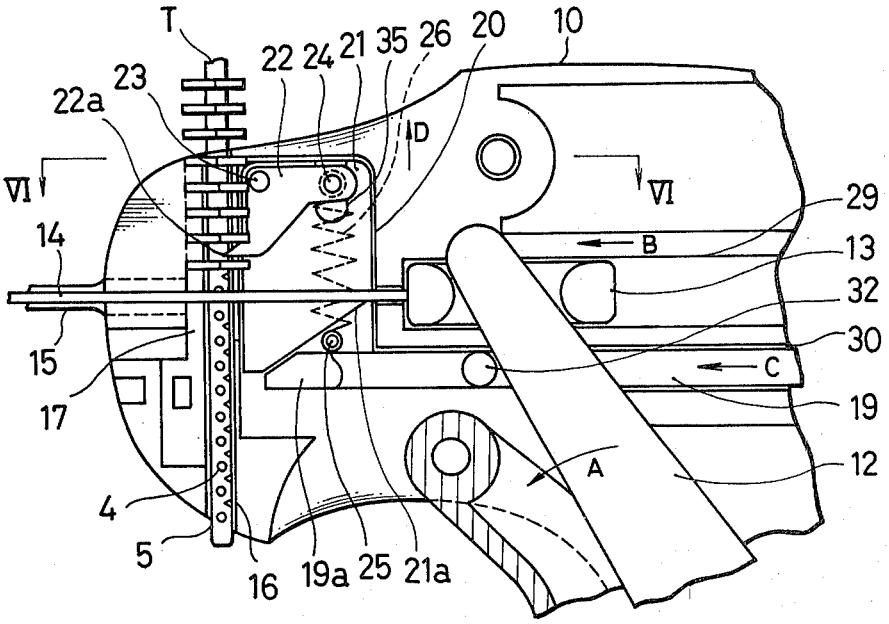
Figure 6:
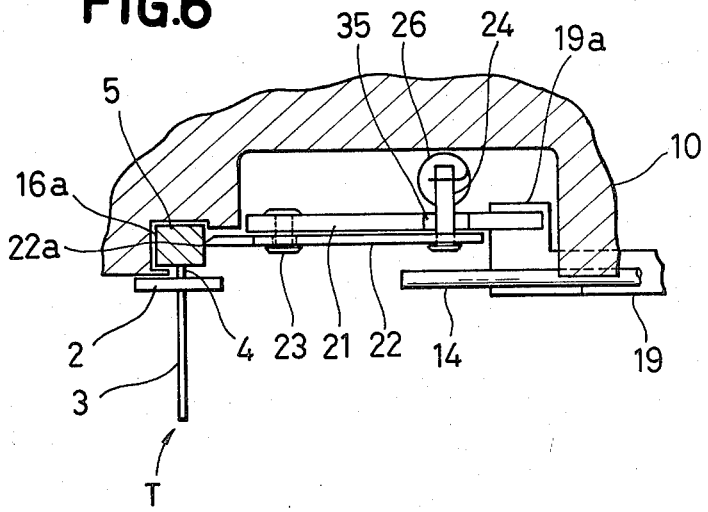
FIG. 6 is a partial sectional view taken substantially along the line VI—VI of FIG. 5.

As best seen from FIGS. 4 and 5, with the intermediate lever 12, its upper end portion is disposed through an elongated opening or hole 31 formed in the slider 13, and the cam driving member 19 is formed with projections 32 and 33, which are located respectively at the front and the rear sides, or the left and the right sides in for example FIG. 4 respectively, of the intermediate lever 12.

The device P includes a hollow needle 15 having a groove 15*a*, which is removably attached to the main body 10 ahead of and in a linear alignment with the push-out rod 14. Behind the needle 15 or rearward of the same, the main body 10 is formed with a guide groove 16 for loading a tag pin assembly T through the same, which groove extends at a right angle to the longitudinal direction of the needle 15, through the main body. As will be seen from FIGS. 1 and 2, the guide groove 16 has an upper half portion lying above the groove 15*a* of the needle 15, which has a substantially cross-like section in a top plan of the device.

For a convenience of description and accordingly facilitating the understanding, a short explanation will be entered next on the structural feature of the tag pin assembly T.

Figure 8:
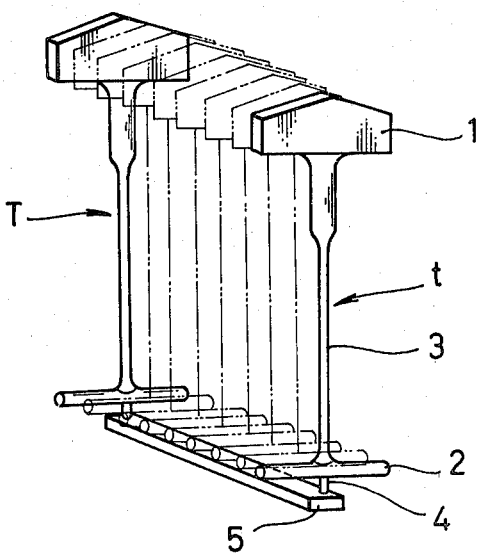
FIG. 8 shows a perspective view of a tag pin assembly.

As shown in the perspective view of FIG. 8, the tag pin assembly T consists of a plurality of individual tag pins t, each of which comprises a head 1 and a crossbar 2 which are connected together by a filament 3. Tag pins t are arranged in a row at predetermined intervals or in a predetermined pitch in the thickness direction of the head 1 and altogether connected to a common connecting bar 5 through their joint portions 4.

Figure 7:
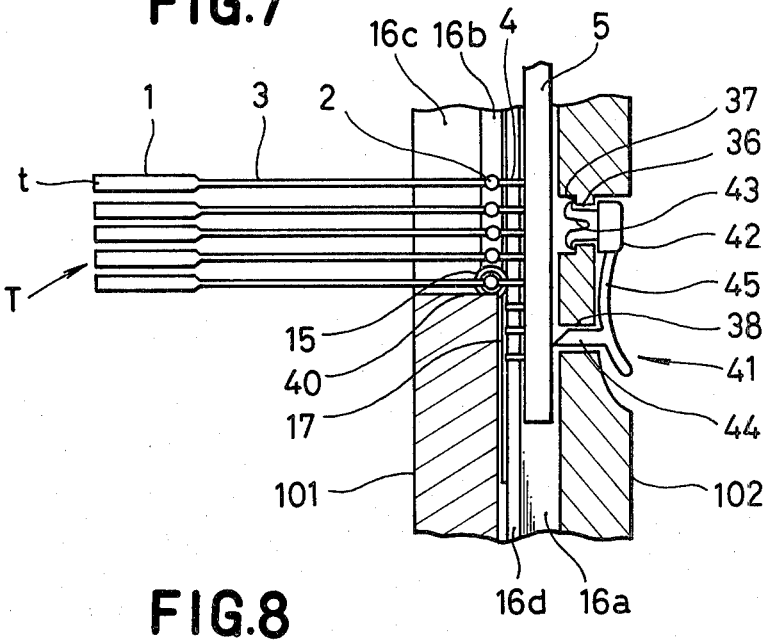
FIG. 7 also is a partial sectional view taken substantially along the line VII—VII of FIG. 1.

Now reverting to FIGS. 1 and 2, the guide groove 16 comprises, in its upper portion above the needle 15*a*, crossing groove portions, which comprise groove portions 16*a*, 16*b*, 16*c* and 16*d*. Portions 16*a* and 16*d* are for passing respectively the connecting bar 5 and the joint portions 4 through, and these groove portions 16*a* and 16*d* are provided through the main body 10. Then, the groove portions 16*b* and 16*c* are adapted to receive respectively the crossbar 2 and the filament of tag pins t. Wall surfaces at which the grooves 16*b* and 16*d* are downwardly terminated from a supporting surface 40 for bearing thereon the crossbar 4 of tag pins of a tag pin assembly T loaded in the groove 16 (FIGS. 1, 2 and 7). The groove 15*a* of the guide needle 15 lies in communication with grooves 16*b* and 16*c* through a communication groove portion 34 (FIG. 1).

As indicated at 20 in FIGS. 4 and 5, a recess is provided between the groove 16 and the slide groove 29 for the slider 13. In this recess 20, a cam plate 21 is mounted in a manner capable of being moved up and down, which has an inclined cam surface 21*a*, which undergoes contact engagement with an end contacting portion 19*a* of the cam driving member 19.

The cam plate 21 has rockably secured thereto through a shaft 23 an engaging pawl or claw member 22, which is disposed such that a sharp edge end thereof is situated at a location corresponding to the location of the groove portion 16*a*. At a rear upper end, the pawl or claw member 22 is supported by a shaft 24, to which one end of a spring 26 is secured with the other end secured to a pin 25 fixed to the main body 10. Normally, the spring 26 biases the cam plate 21 toward below. As its portion corresponding to the location of the shaft 24, the cam plate 21 is formed with a groove or notched portion 35, so that it does not disturb rocking or rotation of the claw or pawl member 22.

For cutting individual tag pins p at their joint portions 4, one at a time, away the assembly T, a cutter knife 17 is provided between the groove portion 16*a* and the hollow guide needle 15, along the portion 16*a* of the guide groove 16.

Also, as shown in FIG. 7, a plastic made stopper 41 is mounted in a manner facing against the groove portion 16*a* so that the loaded tag pin assembly T can be prevented from being upwardly displaced by the action of the claw member 22. The stopper 41 comprises an integrally formed head portion 42 having a bifurcate tongue 43, which engages stepped shoulders 37 of the wall of an opening 36, whereby the stopper 41 is secured to the main body 10. The stopper also has an integrally formed pawl 44, which is inserted in another opening 38 provided adjacent to the opening 36 in the main body and of which the forward end is projected in the groove portion 16*a* by a spring force exerted by a stem or body portion 45 of the plastic made stopper 44.

With the tag attaching device of the invention having the described structural features, the tag attaching operation may be carried out in the following manners.

A tag pin assembly T may be charged in the guide groove 16 in a manner such that the connecting bar 5 of the assembly is compressed by the pawl 44 of the stopper member 41. Then, the operation lever 11 may be driven into the grip portion 10*a* of the main body 10, when the intermediate lever 12 undergoes a pivotal motion in the direction shown by an arrow A as illustrated in FIG. 5, whereby the slider 13 is moved in the slider groove 29 in the direction of an arrow B to drive in the same direction the push-out rod 14 fixed to the slider and, as a result of the above, the crossbar 2 of a first tag pin t positioned behind the hollow needle 15 is forced into the hollow of the needle. At the same time, the joint portion 4 of the first tag pin t is brought into contact with the cutter knife 17, and the tag pin t is severed.

At an appropriate point of the above operation steps, it may be worked to apply the hollow guide needle 15 through a tag to be anchored and through an article to be applied with a tag.

Then, the lever 11 may be further deeply driven into the grip portion, and as it is so operated, the push-out rod 14 accordingly further pushes the crossbar 2 and moves it through the hollow of the needle 15, eventually causing it to become out of the needle.

As it is pivotally driven to a position near the end of its forward stroke, the intermediate lever 12 comes into abutting engagement with the projection 32 of the cam driving member 19 and drives the latter in the direction shown by an arrow C. In consequence, the end contacting portion 19*a* of the cam driving member 19 contacts cam surface 21*a* of the cam plate 21 and drives the cam plate 21 to ascend in the direction of an arrow D overcoming the force of the spring 26.

As a result of the upward movement of the cam plate 21, the engaging claw or pawl 22 undergoes a pivotal motion, and as it is pulled by the spring 26, its sharp front end 22*a* becomes sticking against a side face of the connecting bar 5 of the tag pin assembly T.

As the lever 11 may then be released from application of gripping force after the first tag pin t has applied through the article as above, the spring 12*b* provided between the intermediate lever 12 and the main body 10 functions to let the intermediate lever 12 to undergo its return stroke to the position shown in FIGS. 3 and 4, as well as the slider 13 and the cam driving member 19.

In accordance with the return stroke of the cam driving member 19, the cam plate 21 undergoes descending within the recess 20 on account of the function of the spring 26.

Further, as the cam plate 21 undergoes lowering in its position as above, the engaging claw member 22, too, undergoes descending in the direction of an arrow E shown in FIG. 4 with its front end sticked against the connecting bar 5 of the tag pin assembly. Then, when the crossbar 2 of a second tag pin t is born on the support surface 40 of the main body 10 and is located in the entrance into the needle 15, the lowering motion of the engaging pawl 22 and the cam plate 21 is brought to a halt and, at the same time, the spring 26 becomes no longer exerting a force, whereby the front end 22*a* becomes disengaged from the connecting bar 5.

As described in detail above, in the tag pin dispensing device according to the present invention, tag pins of a loaded tag pin assembly can be fed one at a time by the engaging claw or pawl member and with the sharp front end of such member securely sticked into or against the connecting bar of the tag pin assembly, so that the device can be effectively utilized regardless of a change in the pitch of the tag pin arrangement in the tag pin assembly.

What is claimed is:

1. A tag attaching device for dispensing tag pins joined to a connecting bar which form a tag pin assembly, each said tag pin having a crossbar connected by a filament to a head portion, comprising a main body, operation means supported on said main body for actuating said tag attacher, a hollow needle fixed to said main body, a guide groove formed at the rear side of said hollow needle in said main body, said operation means, when actuated, acting to drive a crossbar of a tag pin into said hollow needle, a cam plate reciprocably disposed adjacent said guide groove so as to be actuatable by said operation means to move between upper and lower positions, an engaging pawl having a sharp front end pivotally mounted to said cam plate and facing said guide groove through which said connecting bar of said tag pin assembly is passed, and spring means mounted between said engaging pawl and said main body for biasing said cam plate towards said lower position, said sharp front end of said engaging pawl member positively engaging said connecting bar of said tag pin assembly when in an upper position so that as said cam plate is actuated by said operation means, said sharp front end selectively positively engages said connecting bar to move said tag pin assembly downward to said lower position to position another tag pin for dispensing through said hollow needle.

2. A tag attaching device as claimed in claim 1, wherein said cam plate has a tapered cam surface, said operation means including a cam drive member loosely fitted thereto, said tapered cam surface being engageable with said cam driving member.

3. A tag attaching device as claimed in claim 1, wherein said engaging pawl member has a spring holding pin fixed thereto, said spring means being coupled to said spring holding pin, said cam plate having a groove in which said spring holding pin fixed to said engaging pawl member extends.

* * * * *